US005246720A

United States Patent [19]

Buchko

[11] Patent Number: 5,246,720

[45] Date of Patent: Sep. 21, 1993

[54] RECLOSABLE PACKAGE AND METHOD OF MAKING SAME

[76] Inventor: Raymond G. Buchko, 1016 E. Florida Ave., Appleton, Wis. 54911

[21] Appl. No.: 913,864

[22] Filed: Jul. 15, 1992

Related U.S. Application Data

[63] Continuation-in-part of Ser. No. 685,873, Apr. 15, 1991, abandoned, which is a continuation-in-part of Ser. No. 496,909, Mar. 21, 1990, abandoned.

[51] Int. Cl.[5] ..... B65D 85/00

[52] U.S. Cl. ..... 426/106; 383/61; 426/129; 426/130

[58] Field of Search ..... 426/129, 122, 123, 386, 426/106; 206/484, 610, 632, 467, 469, 471; 383/61, 63, 210, 211

[56] References Cited

U.S. PATENT DOCUMENTS

| | | | |
|---|---|---|---|
| 3,204,760 | 9/1976 | Whiteford . | |
| 3,217,871 | 11/1965 | Lee . | |
| 3,827,472 | 8/1974 | Uramoto | 229/66 |
| 4,246,288 | 1/1981 | Sanborn, Jr. | 426/122 |
| 4,986,673 | 1/1991 | Bell | 383/61 |

*Primary Examiner*—Steven Weinstein
*Assistant Examiner*—Anthony Weier
*Attorney, Agent, or Firm*—Andrus, Sceales, Starke & Sawall

[57] ABSTRACT

A reclosable package consists of an inner peripheral seal around a product cavity within which the products is disposed, and an outer seal around the inner seal. The area inside the inner seal, containing the product, is preferably evacuated. The outer seal is defined in part by a reclosable assembly which, after breaking of the inner seal, provides access to the interior of the package and reclosability of the package. A method of constructing a package and of packaging a product are also disclosed.

12 Claims, 4 Drawing Sheets

RECLOSABLE PACKAGE AND METHOD OF MAKING SAME

CROSS-REFERENCE TO RELATED APPLICATION

This application is a continuation-in-part of application Ser. No. 07/685,873, now abandoned, which in turn is a continuation-in-part of application Ser. No. 07/496,909 filed Mar. 21, 1990, now abandoned.

BACKGROUND AND SUMMARY

This invention relates to packaging of food products, and more particularly to a reclosable package and method of making a reclosable package in which the food product is contained within an evacuated product cavity.

Common practice in the food packaging industry is to vacuum package food products such as frankfurters, bacon, sliced luncheon meat, cheese and the like. It has been known to form an easy-open peel seal to facilitate access to the package contents. It is also known to provide an interlocking closure assembly between the webs forming the package, in combination with an easy-open peel seal, such as is disclosed in Griesbach et al. U.S. Pat. No. 4,782,951. The Griesbach et al. patent discloses a reclosable package in which an interlocking zipper profile is provided on the facing webs of the package. The zipper profiles are located outwardly of the easy-open peel seal formed about the product.

The present invention has as its object to provide a reclosable package which differs from prior art packages by forming a pair of webs about a product so as to provide distinct outer and inner seals about the product. A portion of the outer seal is defined by a reclosable assembly which allows access to the interior of the package after breaking of the inner seal.

In accordance with one aspect of the invention, a reclosable package comprises a pair of webs, with a product cavity disposed between the webs adapted to receive product to be packaged. A first peripheral inner seal is provided between the pair of webs and encloses the product cavity, and thereby product received therein. A second peripheral outer seal is provided between the pair of webs and is located outwardly of the inner seal. A reclosable interlocking assembly is provided on facing portions of the webs, and forms a portion of the outer seal, for providing access to and reclosability of the product cavity after breaking of the inner seal. The outer seal preferably is located at the margins of the pair of webs and is spaced outwardly from the inner seal. The second seal extends less than the entire periphery of the pair of webs, providing a pair of spaced terminations to the outer seal. The reclosable interlocking closure assembly extends between the terminations of the outer seal, with the outer seal terminations preferably overlapping the closure assembly. In this manner, the outer seal in combination with the reclosable interlocking assembly completely surrounds the inner seal.

In accordance with another aspect of the invention, the pair of webs and the inner seal are formed as described above. The second outer seal is provided only along the side edges of the webs. In one form, the side seals extend throughout the full height of the package, between the top and bottom edges thereof. The side seals are spaced outwardly from the portion of the inner seal disposed adjacent thereto, defining an unsealed space therebetween. In another form, the side seals extend from the top end of the package downwardly along only a portion of the package sides, terminating above the bottom end of the package. The partial side seals extend downwardly past the zipper closure and also past the upper end of the inner seal. The side seals terminate adjacent the outermost extent of the inner seal, defining a space therebetween.

The area located inwardly of the inner seal is preferably evacuated after a product is placed therein, so that the inner seal defines the outer boundary of evacuation of the package. A space is preferably located between the inner seal and the outer seal, with the space not being evacuated.

The invention further contemplates a method of making a package and a method of packaging a product, substantially in accordance with the foregoing description.

BRIEF DESCRIPTION OF THE DRAWINGS

The drawings illustrate the best mode presently contemplated of carrying our the invention.

In the drawings.

DETAILED DESCRIPTION OF THE PREFERRED EMBODIMENT

Figure 1:
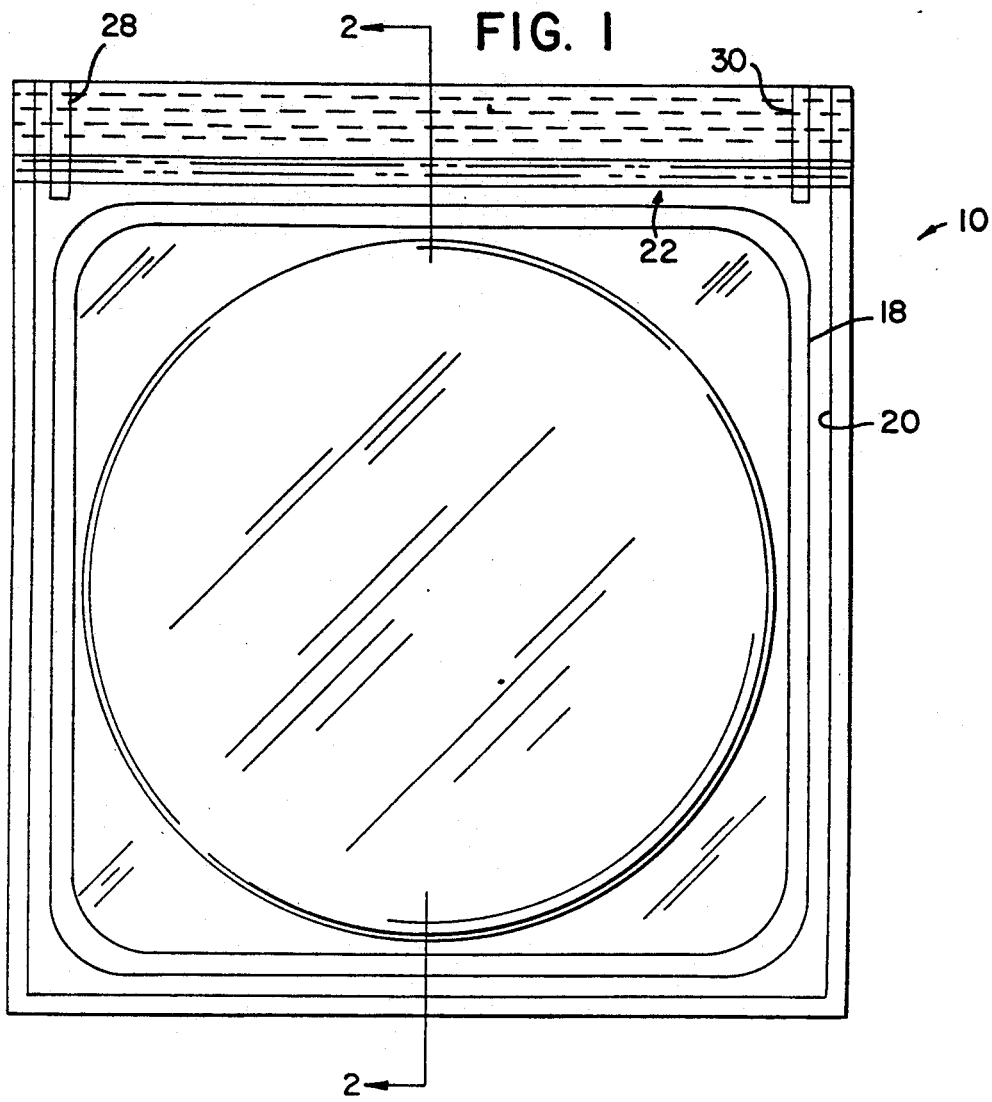
FIG. 1 is a plan view of a package constructed according to the invention.

FIG. 1 illustrates a package 10 for packaging a product. The drawing figures illustrate the product being packaged as a stack of slide luncheon meat, illustrated generally at 12. While the invention is described with reference to this type of product, it is understood that any other type of product which may be suitably package in an evacuated environment is satisfactorily packaged in accordance with the invention.

Figure 2:
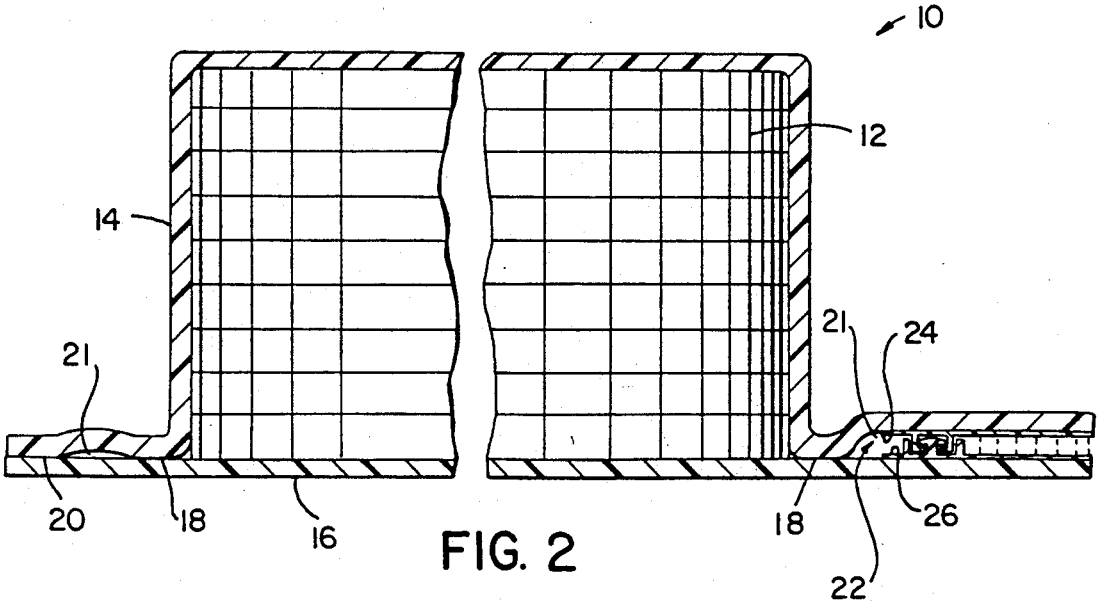
FIG. 2 is a sectional view taken generally along line 2—2 of FIG. 1.
Figure 3:
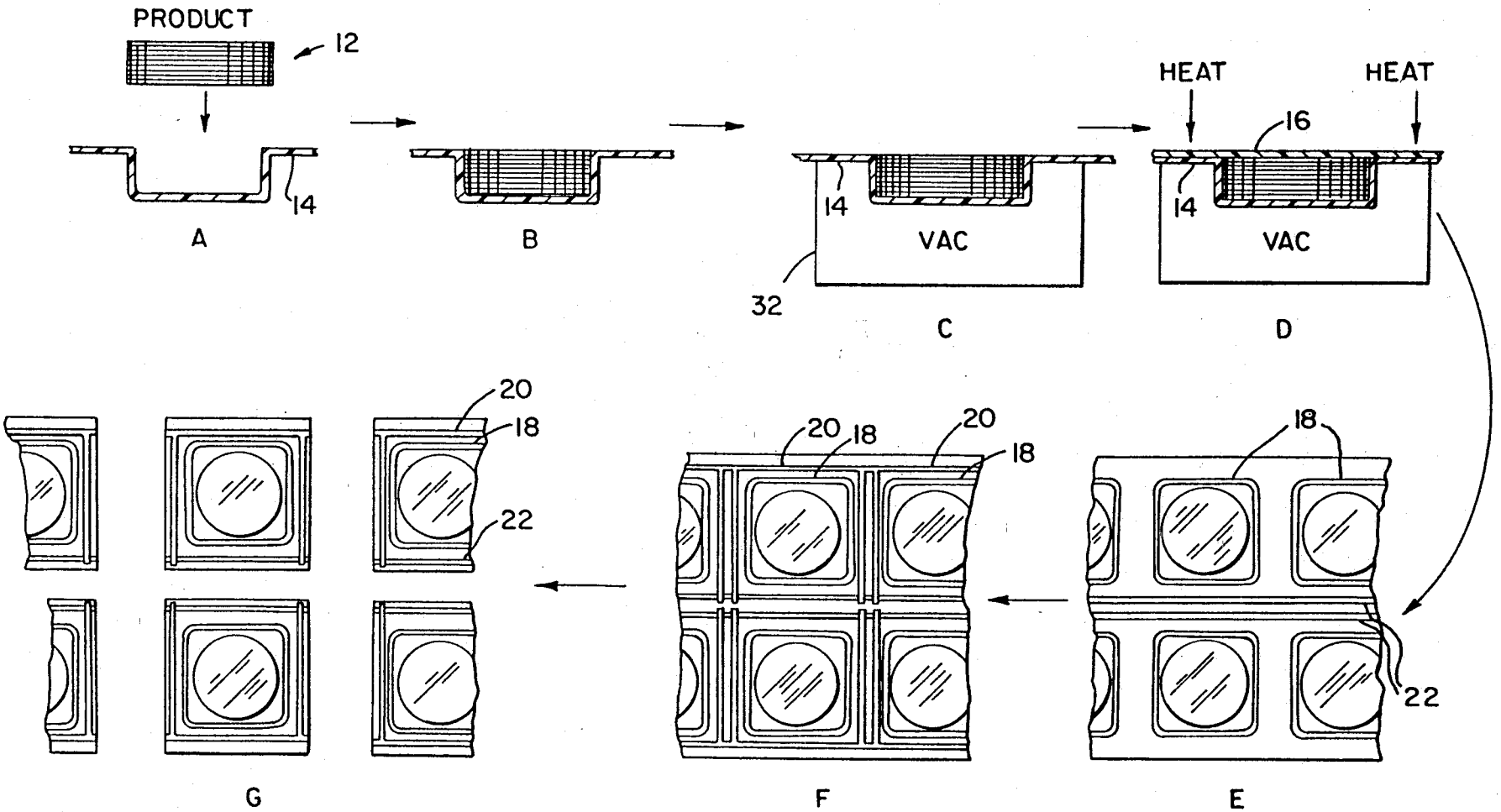
FIG. 3 is a schematic representation of a package making and product packaging process resulting in the package of FIGS. 1 and 2.

As shown in FIG. 2, package 10 generally includes a top web 14 and a bottom web 16. Webs 14 and 16 are illustrated as shown in FIG. 3 for simplicity. It is understood that the webs 14 and 16 may be any satisfactory single-ply or multi-ply laminate material. Such materials are described in detail in Griesbach et al. U.S Pat. No. 4,782,951, referred to above, the disclosure of which is hereby incorporated by reference. Such materials are employed in existing easy-open packaging applications for food products, and are commonly sold by Curwood, Inc., a subsidiary of Bemis Corporation, or the Cryovac Division of W. R. Grace & Co., of Duncan, S.C.

Referring to FIG. 1, package 10 generally includes an inner peripheral seal 18 between webs 14, 16 and an outer seal 20 between webs 14, 16. Inner seal 18 is substantially square in plan with rounded corners, and encloses a central area defining a product cavity within which the product stack 12 is placed. The area inwardly of inner seal 18 is evacuated so as to be free from air, in a manner to be explained, and seal 18 defines the outer boundary of the evacuated area. Inner seal 18 is formed by heating webs 14, 16 along an area corresponding in shape to the final configuration of seal 18. The packaging materials as described previously form an easy-open peel-type seal when heated in this manner, which is sufficient to withstand the forces of shipping, handling and other packaging operations, but which is nonetheless easy for a consumer to break when it is desired to gain access to the interior of the package.

Again referring to FIG. 1, outer seal 20 seals top web 14 and lower web 16 together about three edges of package 10, namely the sides and the bottom of the package. Outer seal 20 is located at the margins of webs 14, 16, and is spaced outwardly from inner seal 19 so as to be separated at all points from inner seal 18 by an air space 21. Air spaces 21 between outer seal 20 and inner seal 18 are well illustrated in FIG. 2. As can be seen, inner seal 18 forms the hermetic seal of an inner evacuated package, while outer seal 30 forms the boundary of an outer non-evacuated package around the inner package defined by inner seal 18.

An interlocking zipper profile, shown generally at 22, is provided at the top of package 10 spanning between the ends of outer seal 20 located at the top of webs 14, 16. Zipper profile 22 generally comprises a top strip 24 and a bottom strip 26 bonded in a manner to be explained to top web 14 and bottom web 16, respectively. Zipper profile 22 may illustratively be that such as manufacture by Presto Products, Inc., of Appleton, Wis., under its designation "Fresh-Trak." As shown, top strip 24 includes a female groove between a pair of zipper side walls, and bottom strip 26 includes a longitudinal male projection adapted to be received within the female groove of top strip 24 for providing an air-tight seal between strips 24, 26 of zipper profile 22 when engaged, it is to be understood, of course, that other satisfactory cooperating interlocking closure strips or profiles may be satisfactorily employed, including that such as disclosed in co-pending U.S. patent application Ser. No. 07/342,257, filed Apr. 24, 1989, and listing the inventor of the subject matter of this application as a co-inventor.

As shown in FIG. 3, top strip 24 and bottom strip 26 of zipper profile 22 further include flange portions located outwardly of the mating groove and projection portions, respectively, which are adapted to accommodate sealing of zipper profile 22 to top and bottom webs 14, 16. The flange portions further include inwardly projecting integrally formed ribs which facilitate opening of zipper profile 22 by a user.

Referring again to FIG. 1, it is seen that the ends of zipper profile 22 overlap the upper terminations of outer seal 20. The heat seal forming outer seal 20 simultaneously fuses the end portions of zipper profile 22 together. Accordingly, the combination of outer seal 20 with zipper profile 22 when its mating groove and projection portions are engaged, define a peripheral outer seal spaced at all locations away from inner seal 18 to define an outer reclosable package separate and distinct from the inner package defined by inner seal 18.

Top and bottom strips 24, 26 of zipper profile 22 are applied in any satisfactory manner to top and bottom webs 14, 16, respectively. Illustratively, top and bottom strips may be applied in a manner as is disclosed in co-pending U.S. application Ser. No. 07/342,257, referred to above, or in any other manner as is known in the art. For example, profile 22 may be applied with its cooperating female groove and male projection mated between top and bottom webs 14, 16. Heat and pressure are applied to top and bottom webs 14, 16 adjacent the flange portions of top and bottom strips 24, 16, respectively, to simultaneously form heat seals between top web 14 and the back side of the flange portion of top strip 24, and between bottom web 16 and the back side of the flange portion of lower strip 26.

A pair of crimp heat seals 28, 30 extending across the width of zipper profile 22 are also provided to further fix the position of zipper profile 22 relative to top and bottom webs 14, 16.

With the construction as described and illustrated, a highly satisfactory reclosable evacuated package is provided for product 12. To gain access to product 12, the user grips the flange portions of zipper profile strips 24, 26 and separates the mating groove and projection portions thereof. Further application of a pull-apart force results in breaking of the upper area of inner seal 18 and a portion of the rounded corners of inner seal 18 between the upper transverse area and the side portions of inner seal 18. Outer seal 20 remains intact at all points during this pull-apart action. After the user has removed a portion of the product 12, package 10 is closed by applying pressure to top and bottom webs 14, 16 over the mating groove and projection portions of zipper profile 22 in a manner as is known, so that zipper profile 22 resumes its position as shown in FIG. 3. This provides a peripheral air-tight seal to the outer area of package 10 separate and distinct from inner seal 18 which has previously been broken, to thereby preserve product 12 until it is fully depleted.

Reference is now made to FIG. 3 for a description of the process for producing package 10 and for packaging product 12 therein. As shown, top web 14 is supplied horizontally to station A, and product 12 is placed on top web 14 at station B. After placement of product 12 on top web 14, a vacuum box 32 at station C draws top web 14 downwardly as shown, in accordance with conventional vacuum packaging technology. Bottom web 16 is then supplied over product 12 between stations C and D. Simultaneously with the supply of bottom web 16, zipper profile 22 is fed between top and bottom webs 14, 16. At station D, heat seals are applied to form inner seal 18.

As shown in stations E, F and G of FIG. 3, a dual-lane configuration is employed to form packages 10. After the inner heat seal 18 is formed at station D the dual-lane inner packages shown at station E are provided. At this station, zipper profiles 22 are not yet bonded to top and bottom webs 14, 16. At station F, the three-sided outer seals 20 are formed outwardly of inner seals 18, with the end portions of outer seals 20 overlapping zipper profiles 22 to fix zipper profiles 22 in position. Simultaneously with the application of outer seals 20, zipper profiles 22 may be bonded to top and bottom webs 14, 16. This provides the secondary package around the primary package formed by inner seal 18. At station G, the individual packages are rough-cut to separate them, with the packages then being transported to a final trimming station to remove excess packaging material.

The inner primary packages formed by seal 18 may be formed, filled, sealed and evacuated or gas flushed using existing technology, as is known in the art.

Additionally, it is to be appreciated that constructing the composite package as described and illustrated leaves open the option of forming a final package by application of inner seal 18 and eliminating the step of forming the outer package therearound, if desired. This provides a low-cost non-resealable evacuated package for product 12.

Figure 4:
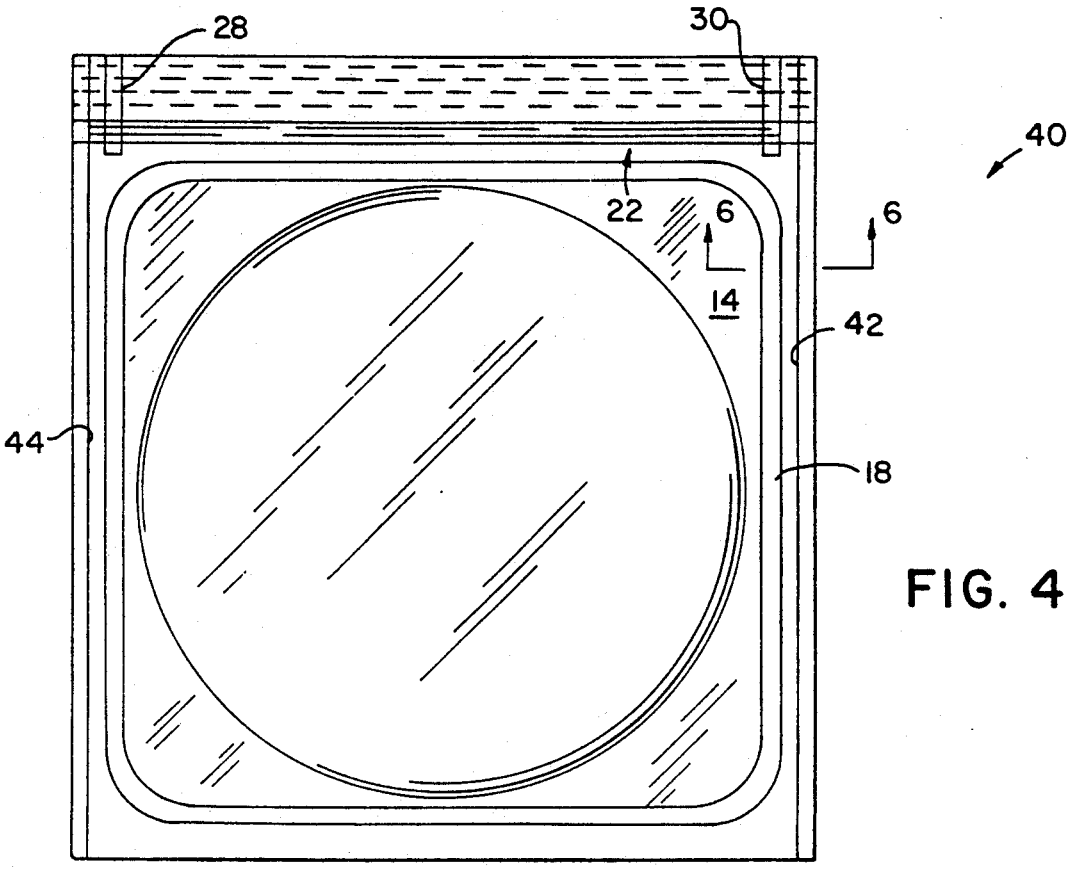
FIG. 4 is a view similar to FIG. 1, showing an alternative embodiment in which the bottom outer seal is eliminated and the outer side seals extend throughout the height of the package.

FIG. 4 illustrates another embodiment of a package, shown at 40, constructed according to the invention. Package 40 is constructed similarly to package 10 shown in FIGS. 1 and 2 and with a similar process as shown in FIG. 3. Package 40 includes an inner seal 18 which defines the boundary of evacuation for the product located inwardly of inner seal 18. In contrast with the peripheral outer seal 20 of package 10, however, package 40 provides an outer seal consisting of a pair of parallel spaced side seals 42, 44. Package 40 has no outer seal outwardly of the bottom portion of inner seal 18.

Figure 6:
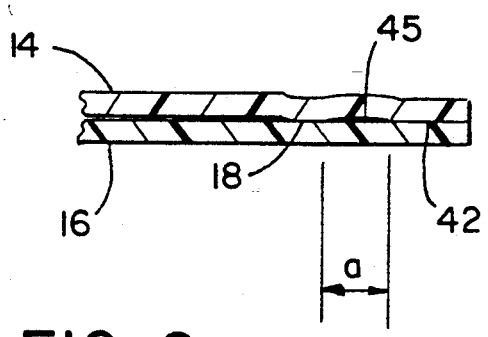
FIG. 6 is a partial sectional view taken along line 6—6 of FIG. 4.

Side seals 42, 44 are provided at the outer side margins of webs 14, 16 forming package 40, extending between the top end and the bottom end thereof. Side seals 42, 44 are spaced outwardly of the parallel vertical side seals provided by inner seal 18, defining an air space therebetween, similar to that shown at 21 in FIG. 2. Referring to FIG. 6 the space defined between inner seal 18 and outer seal 42 is shown at 45.

In a typical construction of package 40, dimension a, the width of space 45 between seals 18 and 42, preferably ranges between 1/16" and ⅛", and illustratively 3/32". It is understood that a space identical to space 45 is likewise located between seals 18 and 44.

Side seals 42, 44 overlap the ends of zipper profile 22, which is in all respects identical to that as shown and described with respect to FIGS. I and 2. Crimp heat seals 28, 30 are again provided to fix the position of zipper profile 22 relative to top and bottom webs 14, 16.

Space 45, defined by side seals 42, 44, in combination with the parallel side edges of inner seal 18 adjacent thereto, constitutes a restriction which prevents any fluids which may be present between webs 14, 16 when the package is opened, from migrating to the lower end of package 40, where webs 14, 16 are not joined below the lower portion of inner seal 18. Fluid present between webs 14, 16 at space 45 adheres to webs 14, 16 and does not migrate downwardly toward the bottom of package 40. It is believed this is attributable to the relatively narrow width of space 45, the closeness of webs 14, 18 at space 45, and well-known fluid adhesion principles. Accordingly, this restriction prevents leakage of any fluids from package 40 after opening, while making it unnecessary to provide a complete peripheral enclosure outwardly of inner seal 18.

Figure 5:
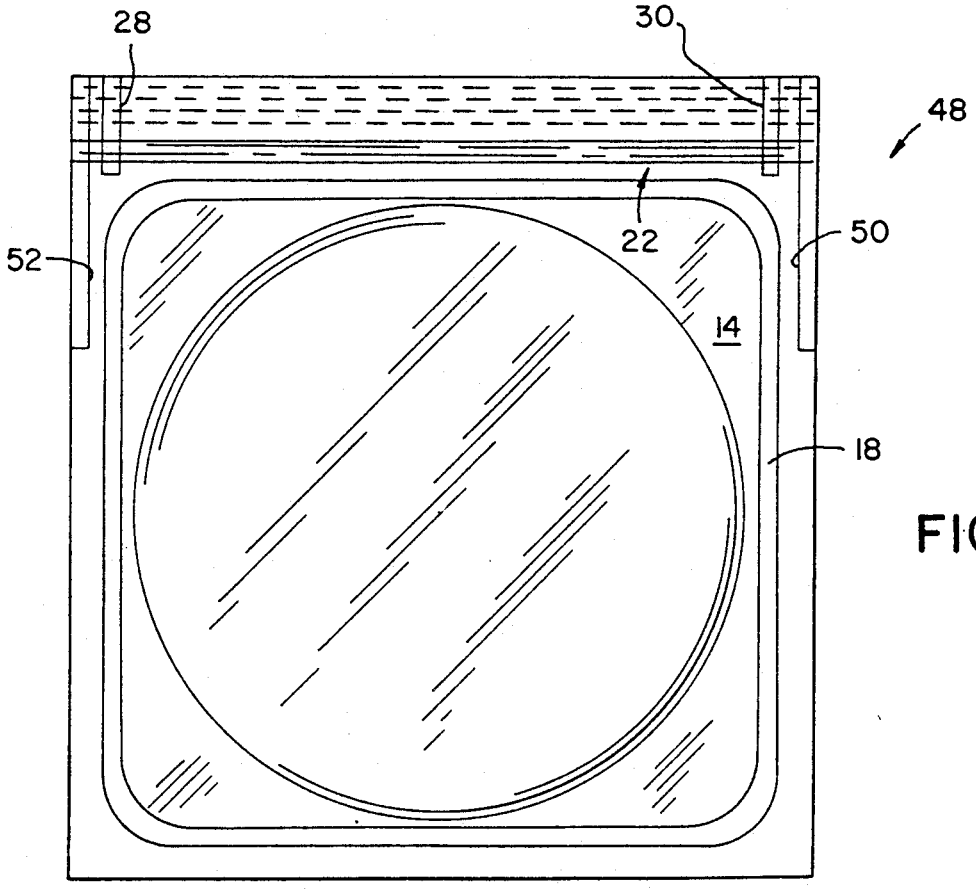
FIG. 5 is a view similar to FIGS. 1 and 4, showing yet another embodiment in which the outer side seals extend throughout only a portion of the height of the package.

FIG. 5 illustrates a package, shown at 48, constructed according to another embodiment of the invention. Package 48 is constructed similarly to package 40 shown in FIG. 4, including a pair of webs 14, 16 having a peripheral inner seal 18 which defines the outer boundary of an evacuated area which packages product located inwardly of inner seal 18. In the embodiment of FIG. 5, however, a pair of outer partial side seals 50, 52 are formed outwardly of the lateral outward side portions of inner seal 18.

Outer partial side seals 50, 52 extend downwardly from the top end of package 48, overlapping the ends of zipper profile 22 and the flanges associated therewith, as described with respect to FIGS. 1 and 2 above. Below zipper profile 22, outer partial side seals 50, 52 extend downwardly only a portion of the height of package 48. FIG. 5 illustrates an embodiment in which outer partial side seals 50, 52 extend approximately 26 percent of the height of the webs 14, 16 between the bottom ends of webs 14, 16 and zipper profile 22. Outer partial side seals 50, 52 terminate below the lateral outwardmost portions of inner seal 18. That is, outer partial side seals 50, 52 extend below the curved upper portions of inner seal 18 which joins the top portion of inner seal 18 with its lateral parallel side portions. Outer partial side seals 50, 52 are parallel to the parallel outer side portions of inner seal 18 to which seals 50, 52 are adjacent.

Each of outer seals 50, 52 cooperates with the lateral outwardmost portions of inner seal 18 to define an air space therebetween, identical that shown at 45 in FIG. 6. The restriction provided by the narrow air space between inner seal 18 and partial seals 50, 52 again prevents liquids, which may be introduced from the product cavity into the space outwardly of the top portion of inner seal 18 upon breaking of inner seal 18 to open the package, from migrating downwardly to the exterior of package 48. This assumes, of course, that when package 48 is opened, inner seal 18 is broken only in the area above the lower end of partial side seals 50, 52. In the event inner seal 18 is broken below the lower end of seals 50, 52, there can no longer be a restriction defined between inner seal 18 and seals 50, 52 to prevent downward migration of liquid.

Again, webs 14, 16 are maintained in close proximity to each other by outer seals 50, 52 and the portion of inner seal 18 adjacent thereto, such that downward flow of fluid between webs 14, 16 is prevented. In this manner, it is unnecessary to complete the side seal below the lower end of side seals 50, 52, and the bottom outer seal is thus also rendered unnecessary.

The elimination of the bottom outer seal in the embodiment of FIG. 4, and of the bottom outer seal and a substantial portion of the outer side seals in the embodiment of FIG. 5, provides substantial economies in the manufacture of packages 40, 48. For example, eliminating the bottom outer seal allows a packager to use only enough web material to allow the bottom portion of inner seal 18 to be formed. The extra material below the bottom of inner seal 18 as illustrated in the embodiments of both FIGS. 4 and 5, can be eliminated. This results in a reduction of the overall amount of material required to form packages 40, 48 and thereby a cost savings to the packager.

In addition, outer side seals 42, 44 in the embodiment of FIG. 4 and partial side seals 50, 52 in the embodiment of FIG. 5, can be formed at a station separate and apart from the station at which peelable inner seal 18 is formed. Preferably, seals 42, 44 and 50, 52, along with crimp seals 28, 30, are formed at a station where the sealing temperature and pressure, exerted by a sealing element as known in the art, are increased over and above that which is employed to form peelable inner seal 18. In this manner, seals 28, 30, 42, 44, 50 and 52 are not peelable, in contrast to inner seal 18. That is, seals 28, 30, 42, 44, 50 and 52 are formed so that webs 14, 16 are permanently bonded together, and any peelable characteristics of the web material are destroyed. Accordingly, it is easy for a user to open the package by breaking the upper portion of inner peelable seal 18, and possibly the upper side portions of inner seal 18, in order to gain access to the product cavity. However, the tough nature of seals 42, 44 and 50, 52 prevents such seals from being broken when the package is opened, and also acts to ensure that the side portions of inner seal 18 are not broken to a point below the lower end of the outer partial side seals, shown at 50,52. This ensures that liquids which may be present between webs 14, 16 above the lower ends of partial outer side seals 50, 52 are trapped in the space between seals 50, 52 and inner seal 18, in a manner as described previously.

With outer partial side seals 50, 52 being formed in a manner so as to permanently bond webs 14, 16 together, by increasing the temperature and pressure exerted on webs 14, 16 to form seals 50, 52, the relatively short length of seals 50, 52 allows the use of tooling requiring less overall pressure to form such seals than is required for forming full length outer side seals 42, 44 in the embodiment of FIG. 4. It can thus also be appreciated that forming full length outer seals 42, 44 requires less overall pressure than is required to form the peripheral outer seal, shown at 20, in the embodiment of FIG. 1. Accordingly, the packaging machine used to form the outer seals can employ lower capacity components in forming the partial outer seals, thus reducing the overall cost of the packaging machine.

Seals 18, 20, 28, 30, 42, 44, 50 and 52 are illustratively ⅛" to 3/16" wide.

Webs 14, 16, which are used to construct all embodiments of the package of the invention, can be any conventional packaging web material as known to one of ordinary skill in the art. For example, web 16 may be a thermoformable thermoplastic material, such as a laminate of nylon and polyethylene, which may have a gas barrier layer or layers from materials such as saran or hydrolyzed ethylene vinyl acetate copolymer. Web 14 is preferably of a lighter gauge than web 16, and may be a thermoplastic sheet such as a nylon or polyester/polyethylene laminate. Web 14 may include a layer of gas barrier material such as saran or hydrolyzed ethylene vinyl acetate copolymer, to serve as a sealing layer. Further, the material of webs 14, 16 may include one or more lamina of a polyvinyl iodine chloride film, or other suitable peelable or breakaway seals such as can be formed between ethylene-polar monomer copolymer films or coatings. The laminates which may comprise webs 14, 16 in all cases include a suitable oxygen barrier film.

Various alternatives and embodiments are contemplated as being within the scope of the following claims particularly pointing out and distinctly claiming the subject matter regarded as the invention.

I claim:

1. A reclosable package, comprising:

a pair of separate webs each defining a top margin, a bottom margin, and a pair of side margins;

a product cavity located between the webs for receiving a product to be packaged;

a peripheral inner seal bonding the pair of webs together, the inner seal defining the periphery of the product cavity enclosing the product received therein, the inner seal including a lateral side portion located inwardly of each side margin of the webs, an upper portion located inwardly of the web upper margins, and a bottom portion located inwardly of the web bottom margins, said inner seal being a peelable seal;

a pair of separate outer side seals located one at each side margin of the pair of webs, with each outer seal being located outwardly of and adjacent a lateral side portion of the inner peripheral seal, wherein each outer seal extends downwardly along a side margin of the pair of webs from the top margin of the pair of webs and wherein the bottom margin of the webs are bonded substantially together only by the inner seal, said outer side seals being permanently bonded seals; and a reclosable assembly fastened to the webs adjacent the top margins of the pair of webs, wherein the reclosable assembly includes a pair of spaced ends located one adjacent each side margin of the pair of webs, wherein the outer seals overlap the ends of the reclosable assembly, wherein a space is defined between each of the separate outer side seals and the lateral side portion of the inner seal such that said space is of a dimension sufficient to prevent migration of liquid down through said space after the upper portion of the inner seal is broken to gain access to the product cavity.

2. The reclosable package of claim 1, wherein the product cavity is evacuated inwardly of the peripheral inner seal.

3. The reclosable package of claim 1, wherein the reclosable means comprises facing interlocking means provided on said web.

4. The reclosable package of claim 3, wherein the interlocking means comprises a mating zipper profile provided between said pair of webs.

5. The reclosable package of claim 1, wherein each outer side seal extends throughout the height of the pair of webs between the top margins and the bottom margins of the webs.

6. A reclosable package, comprising:

a pair of webs each defining a top margin, a bottom margin and a pair of side margins;

a product cavity located between the webs for receiving a product to be packaged;

a peripheral inner seal bonding the pair of webs together, the inner seal defining the periphery of the product cavity enclosing the product received therein, said inner seal being a peelable seal;

a pair of separate outer side seals located one at each side margin of the pair of webs, with each outer side seal being located outwardly of a lateral side portion of the inner peripheral seal to define a space therebetween such that said space is of a dimension sufficient to prevent migration of liquid down through said space after an upper portion of the inner seal is broken to gain access to the product cavity, wherein each outer side seal extends downwardly along a side margin of the pair of webs from the top margins of the pair of webs throughout only a portion of the height of the webs, terminating at a point above the bottom margin of the pair of webs and wherein the bottom margins of the webs are bonded substantially together only by said inner seal, said outer side seals being permanently bonded seals; and a reclosable assembly fastened to the webs adjacent the top margin of the pair of webs, wherein the reclosable assembly includes a pair of spaced ends located one adjacent each side of the pair of webs, wherein the outer side seals overlap the ends of the reclosable assembly.

7. The reclosable package of claim 6, wherein the portions of the webs below the lower ends of the outer side seals and outwardly of the inner seal are not bonded together so that the web bottom margins and a lower portion of the web side margins are apart from each other.

8. A method of making a package, comprising the steps of:

providing a pair of webs each defining a low margin, a bottom margin and a pair of side margins;

positioning a product between the pair of webs;

bonding the pair of webs together outwardly of the product to form a peripheral inner seal about the periphery of the product to enclose the product, the inner seal including a lateral side portion located inwardly of each side margin of the webs, an upper portion located inwardly of the web upper margins, and a bottom portion located inwardly of the web bottom margins, said inner seal being a peelable seal;

forming a pair of separate outer side seals by bonding the pair of webs together along the side margins of the pair of webs, each side seal extending downwardly from the top margin of the pair of webs, and each side seal being located outwardly of and adjacent a side portion of the inner seal, wherein the bottom margins of the webs are substantially bonded together only by the inner seal, said outer side seals being permanently bonded seals, and wherein a space is defined between each of the separate outer side seals and the lateral side portion of the inner seal such that said space is of a dimension sufficient to prevent migration of liquid down through said space after the upper portion of the inner seal is broken to gain access to the product cavity; and securing a reclosable assembly to the pair of webs adjacent the top margins of the pair of webs, wherein the reclosable assembly includes a pair of spaced ends located one adjacent each side margins of the pair of webs, wherein the outer seals overlap the ends of the reclosable assembly.

9. The method of claim 8, further comprising the step of evacuating the area between said webs inwardly of said inner seal.

10. The method of claim 9, wherein the step of securing a reclosable assembly to the pair of webs comprises securing interlocking closure strips one to each web.

11. The method of claim 8, wherein the step of forming a pair of separate outer side seals comprises bonding the pair of webs together throughout the full height of the pair of webs between the top margin and the bottom margin of the pair of webs.

12. A method of making a package comprising the steps of:

providing a pair of webs each defining a top margin, a bottom margin and a pair of side margins;

positioning a product between the pair of webs;

bonding the pair of webs together outwardly of the product to form a peripheral inner seal about the periphery of the product, said inner seal being a peelable seal;

forming a pair of separate outer side seals by bonding the pair of webs together along the side margins of the pair of webs, each side seal extending downwardly from the top margin of the pair of webs and terminating in a lower end, and being located outwardly of an adjacent portion of the inner seal, so as to form a space between each of the separate outer side seals and the portion of the inner seal located adjacent each outer seal such that said space is of a dimension sufficient to prevent migration of liquid down through said space after the upper portion of the inner seal is broken to gain access to the product cavity, said outer side seals being permanently bonded seals; and securing a reclosable assembly to the pair of webs adjacent the top margins of the pair of webs, wherein the reclosable assembly includes a pair of spaced ends located one adjacent each side margin of the pair of webs, wherein the outer seals overlap the ends of the reclosable assembly;

wherein the step of forming a pair of separate outer side seals comprises bonding the pair of webs together along only a portion of the height of the pair of webs, the outer side seals extending downwardly from the ends of the reclosable assembly and below portion of the inner seal defining the lateral outward extent of the inner seal so that the lower end of each outer side seal is located above the bottom margin of the pair of webs and wherein the bottom margins of the webs are bonded substantially together only by said inner seal.

* * * * *

UNITED STATES PATENT AND TRADEMARK OFFICE

CERTIFICATE OF CORRECTION

PATENT NO. : 5,246,720

DATED : September 21, 1993

INVENTOR(S) : RAYMOND G. BUCHKO

It is certified that error appears in the above-identified patent and that said Letters Patent is hereby corrected as shown below:

Claim 8, Col. 9, Line 3, delete "low" and substitute therefor -- top --; Claim 11, Col. 10, Line 1, after "together" insert -- with said outer side seals --; Claim 12, Col. 10, Line 38, delete "portion" and substitute therefor -- portions --.

Signed and Sealed this

Fifth Day of April, 1994

Bruce Lehman

BRUCE LEHMAN

*Commissioner of Patents and Trademarks*

*Attest:*

*Attesting Officer*